United States Patent [19]

Mascia et al.

[11] 4,135,647

[45] Jan. 23, 1979

[54] MOTOR DRIVEN DISPENSING UNIT FOR CONTAINERS

[75] Inventors: Carmen T. Mascia, Clarendon Hills; Gary K. Hasagawa, Chicago, both of Ill.

[73] Assignee: The Continental Group, Inc., New York, N.Y.

[21] Appl. No.: 835,346

[22] Filed: Sep. 21, 1977

[51] Int. Cl.[2] ..... F04B 43/12

[52] U.S. Cl. ..... 222/211; 222/214; 222/325; 222/383

[58] Field of Search ..... 222/207, 211, 214, 325, 222/382, 383, 82; 417/476

[56] References Cited

U.S. PATENT DOCUMENTS

| | | | |
|---|---|---|---|
| 2,662,666 | 12/1953 | Lamont | 222/214 X |
| 3,289,897 | 12/1966 | Ginsberg | 222/385 X |
| 3,384,080 | 5/1968 | Muller | 222/214 X |
| 3,486,663 | 12/1969 | Humphrey | 222/207 |
| 4,046,289 | 9/1977 | Teranishi | 222/333 X |

*Primary Examiner*—David A. Scherbel
*Attorney, Agent, or Firm*—Charles E. Brown

[57] ABSTRACT

A dispensing unit mountable on a can and like container for dispensing a liquid contents therefrom. The dispensing unit includes a resilient tube which is passed into the can and has a portion seated on the end wall of the can and terminates in a nozzle. A pumping unit is mounted in overlying relation to the tube portion lying on the end wall and is operable progressively and intermittently to apply pressure against the tube portion to collapse the same in a pumping action. The dispensing unit is battery powered electric motor driven and may include a detachable supporting base carrying a battery charger.

10 Claims, 3 Drawing Figures

FIG.1
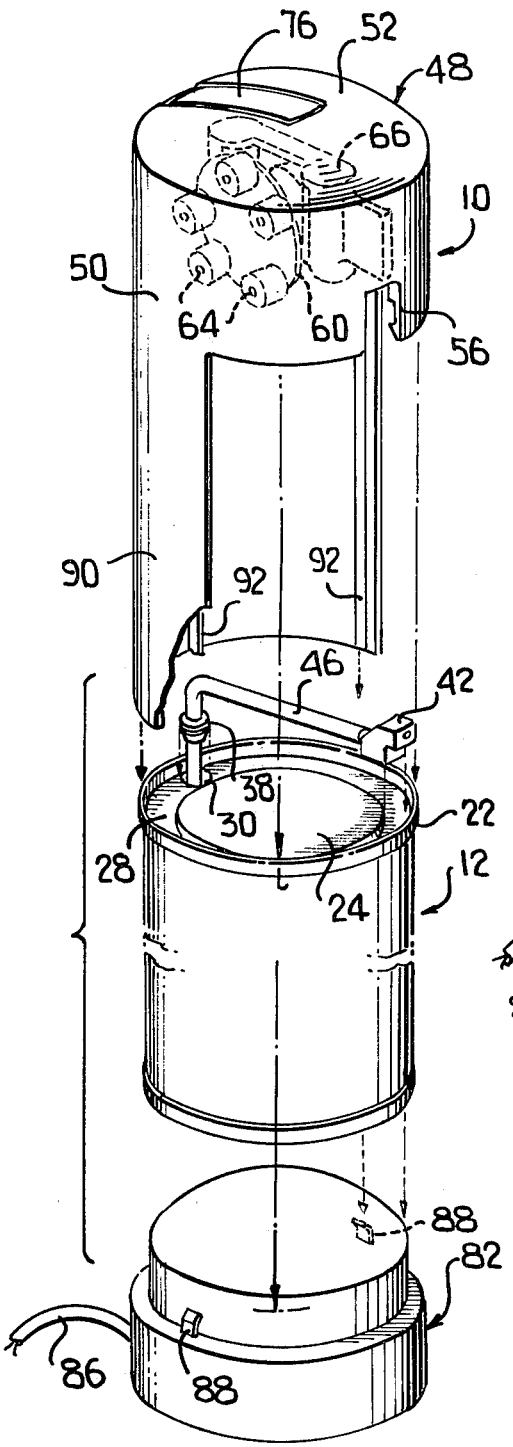
FIG.2
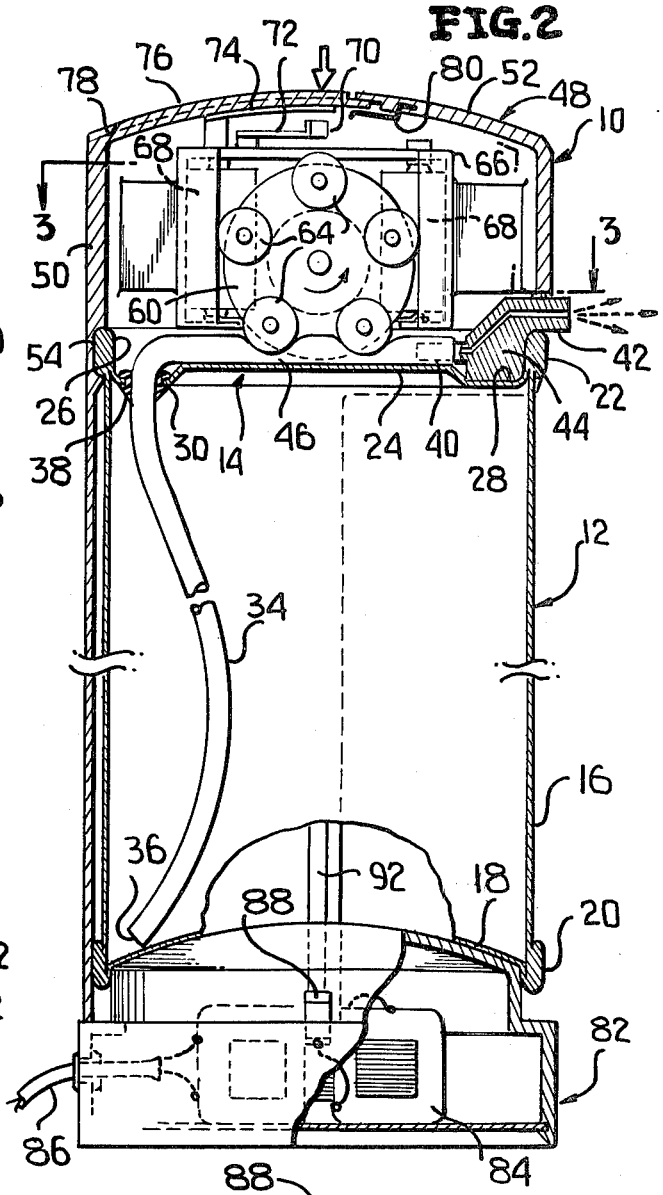
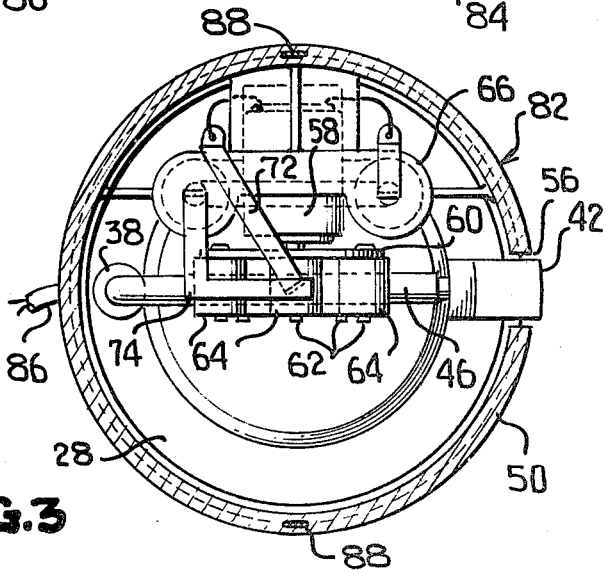
FIG.3

MOTOR DRIVEN DISPENSING UNIT FOR CONTAINERS

This invention relates in general to new and useful improvements in means for effecting the dispensing of products for containers such as cans, and more specifically to a dispensing unit which is cooperable with a conventional can for dispensing the contents thereof through a tube inserted down into the can.

Over a period of years there have been developed various types of mechanisms for effecting the dispensing of contents of cans and like containers. For a period of time the dispensing means were in the form of pumps which were removably secured to the containers with the containers being primarily of the bottle type. In more recent years the containers have been built with internal propellants for pressurizing the product dispensed therein, either directly or indirectly. These cans have been generally classified as aerosol cans and in most instances have utilized gases which are inert as far as the product is concerned, but which have proved to be detrimental to the ecology. Accordingly, it is now the desire of the packaging industry to provide means for readily dispensing products from cans and like containers without utilizing these undesirable gases.

In accordance with this invention there is provided a dispensing unit whcih may be readily associated with a conventional type of container, such as a can, and which may be utilized periodically to dispense the contents of the can in a spraying fashion. Such a dispensing unit simply includes a tube which is insertable into the container through the upper end wall thereof after a small aperture has been formed and an upper portion of the tube is positioned to lie against the upper end wall. This is followed by positioning a carrier in overlying interlocked relation with respect to the container and the carrier carrying a pumping unit which includes a rotating head having a plurality of rollers which intermittently and progressively engage the portion of the tube overlying the end wall to collapse the tube and effect the flow of the product of the container therethrough.

That portion of the tube overlying the end wall may be positioned by means of a simple grommet carried thereby and inserted in an opening in the end wall. The tube is further positioned on the end wall by means of a nozzle at the outlet end thereof, which nozzle is seatable against the end wall and the surrounding upstanding chime or chuck wall. Further, the pumping unit is carried by a housing or carrier which interlocks with the nozzle both to align the pumping unit with the tube portion and to position the nozzle.

Beneficially the dispensing unit includes a battery powered electric motor which is readily controlled by a switch mounted as part of the housing. The dispensing unit also beneficially includes a base for the carrier which base is provided with a battery charger which is automatically connected to the batteries when the carrier is positioned on the base.

A further feature of the dispensing unit is that the carrier is configurated to have received therebeneath a can which is seated on the base and wherein the carrier is at the same time seated on that base with the batteries thereof connected to the battery charger, whereby a charging of the batteries may be effected during periods of non-dispensing.

With the above and other objects in view that will hereinafter appear, the nature of the invention will be more clearly understood by reference to the following detailed description, the appended claims, and the several views illustrated in the accompanying drawings.

IN THE DRAWINGS:

FIG. 1 is an exploded perspective view of the dispensing unit and shows the same partially associated with a can.

FIG. 2 is a vertical sectional view taken through the center of the dispensing unit assembled with a can for dispensing the contents thereof.

FIG. 3 is a transverse sectional view taken generally along the line 3—3 of FIG. 2 and shows the general relationship of the dispensing unit with respect to a can, the contents of which are to be dispensed.

In accordance with this invention there is provided a dispensing unit, generally identified by the numeral 10, which is particularly constructed for mounting on a conventional container of the can type and the like for dispensing the products thereof. A typical can with which the dispensing unit 10 may be readily associated is generally identified by the numeral 12. The can 12, except for the configuration of an upper end unit, generally identified by the numeral 14, may be of any conventional construction and includes a body 16 and a bottom end unit 18 which may be secured to the body 16 in any manner including an illustrated double seam 20.

The upper end unit 14 is secured to the upper portion of the body 16 by means of a conventional double seam 22 with the double seam 22 defining a projection or chime which will be utilized in attaching the dispensing unit 10 to the can 12. The end unit 14 includes an end panel 24 which is configurated to define immediately adjacent a chuck wall 26 thereof an upwardly opening annular groove 28.

In order that the dispensing unit 10 may be mounted on the can 12, it is necessary to form in the end panel 24 a dispensing opening 30 which is preferably circular in outline. The dispensing opening 30 is formed in the lower wall of the annular recess 28 and is preferably preformed and sealed by a removable tear strip (not shown).

The dispensing unit 10 includes a resilient tube 34 which is passed down through the opening 30 and has an inlet end 36 disposed at the bottom of the can so that all of the product of the can may be dispensed. In order to seal the can and at the same time fixedly position an intermediate portion of the tube 34, there is provided on the tube a grommet 38 which may be readily snapped into the opening 30 and interlocked with the end panel 24.

The tube 34 terminates in an outlet end 40 to which is coupled a nozzle 42. The nozzle 42 has a base portion 44 which is seatable in the recess 28 and against the chuck wall 26 with a portion of the nozzle 42 also being seated on the upper edge of the double seam 22. The interlocking of the grommet 38 with the end panel 24 and the positioning of the nozzle 42 results in an intermediate portion 46 of the tube 34 overlying and being seated on the end panel 24.

The dispensing unit 10 also includes a housing or carrier 48 which includes a cylindrical skirt portion 50 and an end wall 52. A lower part of the skirt 50 is provided with an inner recess 54 for receiving and interlocking with the chime defined by the double seam 22. Thus, the carrier 48 may be applied to the can 12 and interlocked therewith as a unit. It is to be noted that the skirt 50 has an opening 56 therein which is of a size snuggly to receive the nozzle 42. The relationship of the carrier 48 with respect to the nozzle 42 is one which both assures the proper seating of the nozzle 42 on the end panel 24 and the proper orientation of the carrier 48 with respect to the tube portion 46.

Positioned within the carrier 48 and mounted thereby is an electric motor 58 which, in turn, carries a rotatable member 60. The rotatable member 60 carries a plurality of mounting pins 62 and rotatably journalled on the pins 62 are rollers 64. The rollers 64 project to one side of the rotatable member 60 and are arranged in generally parallel circumferentially spaced relation.

In order that the electric motor 58 may be energized, there is provided a battery pack 66 which preferably carries rechargeable batteries 68.

The electric motor 58 may be energized by means of a simple switch 70 which in the illustrated form includes two leads 72 and 74 which are normally separated but may be moved into contacting relation by means of an actuator 76 formed as part of the top wall 52 of the carrier 48. The actuator 76 is hinged to the top wall 72 as at 78 and movement thereof to a switch closing position is normally resisted by a spring 80.

As will be apparent from FIGS. 2 and 3, when the carrier 48 is positioned on the can 12, the rollers 64 will overlie and compress the tube portion 46. When the rotatable member 60 is rotated in a counterclockwise direction, the rollers 64 will intermittently engage the upper surface of the tube portion 46 and effect collapsing thereof. As each roller 64 progresses to the right, as viewed in FIG. 2, it will force the liquid within the tube portion 46 in front of it to the right and out through the nozzle 42. At the same time, as the tube portion regains its original cross-section due to the inherent resiliency thereof, a vacuum will be drawn rearwardly of the roller so as to draw other of the product up out of the can.

Inasmuch as the carrier 48 is readily interlocked with the can 12, it will be seen that the carrier 48 retains its position on the can 12 ready to dispense the product therefrom by merely depressing the switch actuator 76. The dispensing unit 48 is relatively compact and light and does not result in a package which cannot be readily handled.

It is to be understood that it is desirable periodically to recharge the batteries 68. To this end the dispensing unit 10 also includes a base, generally identified by the numeral 82. The base 82 has mounted therein a conventional battery charger 84 with a power supply line 86 extending out from the base 82 for plugging into a convenient electrical receptacle. The battery charger 84 has a pair of remote outlet contacts 88 about the periphery of the base 82.

The skirt 50 of the carrier 48 includes an extension 90 which includes a lower end which is seatable on the base 82 so as to provide a support for the carrier 48 either together with or independently of the can 12. The skirt extension 90 carries a pair of contact strips 92 which are engageable with the contacts 88. It is to be understood that the base 82 will be so configured that the skirt extension 90 will seat thereon in only one position and that being a position where the contact strips 92 engage the contacts 88.

Cans, such as the cans 12, are formed of a uniform height for a particular size. Accordingly, it is possible to engage the carrier 48 on the can 12 in dispensing relation and at the same time to seat the can 12 on the base 82 with the contact strips 92 engaging the contacts 88 whereby the batteries 68 may be recharged even if the dispensing unit 10 is associated with the can 12. When it is desired to dispense the product of the can 12, it is merely necessary to lift the can 12 and the dispensing unit 10 as a unit off of the base 82 and dispense the product.

Although only a preferred embodiment of the dispensing unit has been specifically illustrated and described herein, it is to be understood that minor variations may be made in the dispensing unit without departing from the spirit and scope of the invention as defined by the appended claims.

What is claimed as new is:

1. A dispensing unit for dispensing the contents of a can and like containers, said dispensing unit comprising a resilient tube having an inlet at one end and a dispensing nozzle at the other end, mounting means for mounting a portion of said tube against a wall of a container, a mechanism for intermittently and progressively applying pressure against said tube portion to effect a moving collapsing thereof against the same container wall and thus produce a pumping action in said tube, and a carrier for said mechanism, said carrier having attaching means for releasable attachment to the same container for positioning said mechanism relative to said tube portion.

2. The dispensing unit of claim 1 wherein said mounting means for said tube portion includes a device for positioning said tube in an opening in the same container wall.

3. The dispensing unit of claim 1 wherein said mounting means for said tube portion includes a device for positioning said tube in an opening in the same container wall and said nozzle is configurated for seating engagement on the same container wall.

4. The dispensing unit of claim 3 wherein said carrier is configurated to engage and position said nozzle on the same container.

5. The dispensing unit of claim 3 together with the same container in the form of a can having an upper end unit, said end unit including an end panel defining an outer annular recess, said nozzle having a base seated in said recess.

6. The dispensing unit of claim 1 wherein said mechanism includes a rotatable drive member having mounted thereon in generally parallel circumferential spaced relation a plurality of rollers.

7. The dispensing unit of claim 6 wherein an electric drive motor is coupled to said drive member for rotating said drive member.

8. The dispensing unit of claim 1 wherein said carrier attaching means includes means lockable about an annular projection on an upper portion of the same container.

9. The dispensing unit of claim 1 together with a base for said carrier, said carrier being of a dimension for seating on both said base and a respective container carried by said base.

10. The dispensing unit of claim 9 wherein said mechanism includes a battery power electric motor, said base carries a battery charger, and said carrier has electric leads which connect to said battery charger when said carrier is seated on said base.

* * * * *